US008288932B2

(12) United States Patent
Nakashima et al.

(10) Patent No.: US 8,288,932 B2
(45) Date of Patent: Oct. 16, 2012

(54) FILAMENT LAMP

(75) Inventors: Akinobu Nakashima, Himeji (JP); Kenji Tanino, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 92 days.

(21) Appl. No.: 12/557,875

(22) Filed: Sep. 11, 2009

(65) Prior Publication Data

US 2010/0072876 A1 Mar. 25, 2010

(30) Foreign Application Priority Data

Sep. 22, 2008 (JP) ..... 2008-242353

(51) Int. Cl.
*H01K 9/00* (2006.01)

(52) U.S. Cl. ..... 313/316; 313/9; 313/343; 313/344

(58) Field of Classification Search ..... 313/9, 578–580, 313/316, 331–334, 341, 343–344
See application file for complete search history.

(56) References Cited

U.S. PATENT DOCUMENTS

| | | | | |
|---|---|---|---|---|
| 4,233,543 | A * | 11/1980 | Hickok | 315/75 |
| 4,442,374 | A * | 4/1984 | Morris et al. | 313/316 |
| 4,710,676 | A * | 12/1987 | Morris et al. | 313/579 |
| 6,517,224 | B2 * | 2/2003 | Zakerzewski | 362/430 |
| 6,614,008 | B2 | 9/2003 | Tidrick | |
| 7,639,930 | B2 | 12/2009 | Mizukawa et al. | |
| 7,656,079 | B2 | 2/2010 | Mizukawa et al. | |
| 2001/0029119 | A1 * | 10/2001 | Chung | 439/91 |
| 2002/0011790 | A1 * | 1/2002 | Holzer | 315/56 |
| 2003/0111457 | A1 * | 6/2003 | Tidrick | 219/483 |
| 2006/0197454 | A1 | 9/2006 | Mizukawa et al. | |
| 2006/0227558 | A1 * | 10/2006 | Osawa et al. | 362/351 |
| 2007/0057610 | A1 * | 3/2007 | Allen et al. | 313/17 |
| 2008/0050104 | A1 * | 2/2008 | Mizukawa et al. | 392/416 |

FOREIGN PATENT DOCUMENTS

EP 1 998 358 A2 12/2008

* cited by examiner

*Primary Examiner* — Joseph L Williams
*Assistant Examiner* — Fatima Farokhrooz
(74) *Attorney, Agent, or Firm* — Roberts Mlotkowski; Safran & Cole, P.C.; David S. Safran

(57) ABSTRACT

A filament lamp having a filament and an internal lead in which the filament is insulated from contact with the internal lead and prevent from moving during operation to maintain a uniform distribution of light. To this end, the filament lamp includes a luminous tube having an inner wall, and opposing ends on which sealing parts are formed. Multiple filaments are sequentially disposed inside the tube in an axial direction, and internal leads are connected to each filament. An insulating wall is provided along the inner wall of the luminous tube in the axial direction and is disposed around at least one of the multiple filaments. Internal leads running partly parallel to the filaments are positioned between the luminous tube and insulating wall and do not engage the ring supporters of the multiple filaments, which could cause the filaments to move and distribute light in a nonuniform pattern.

14 Claims, 7 Drawing Sheets

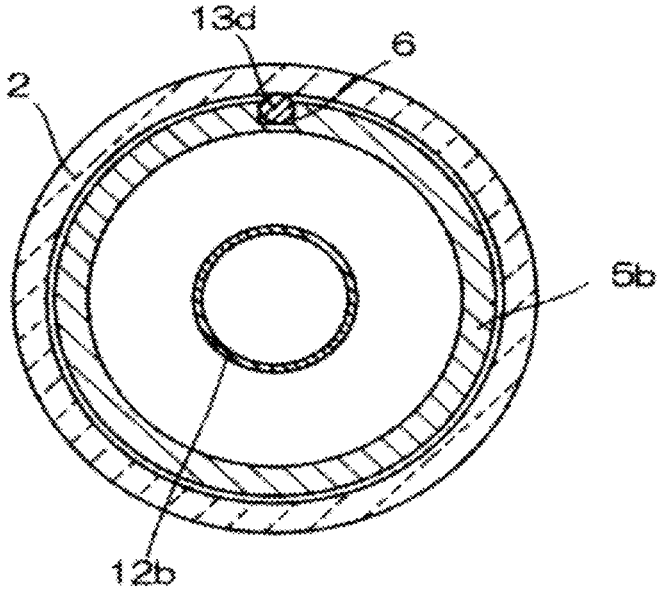
Fig. 3
Fig. 4
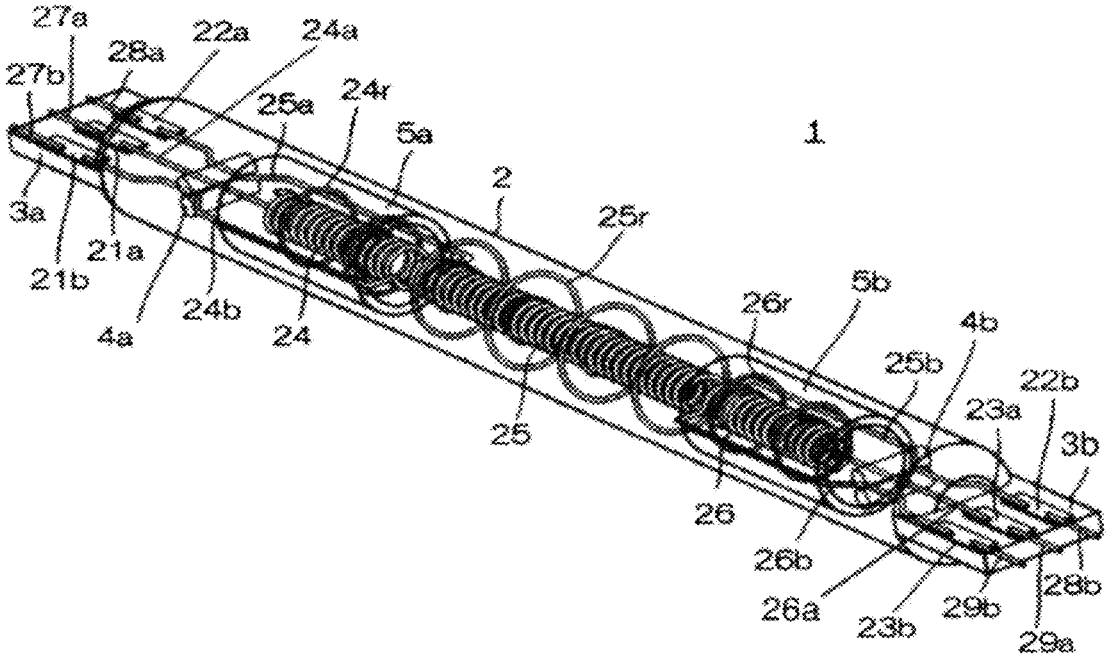

Fig. 7
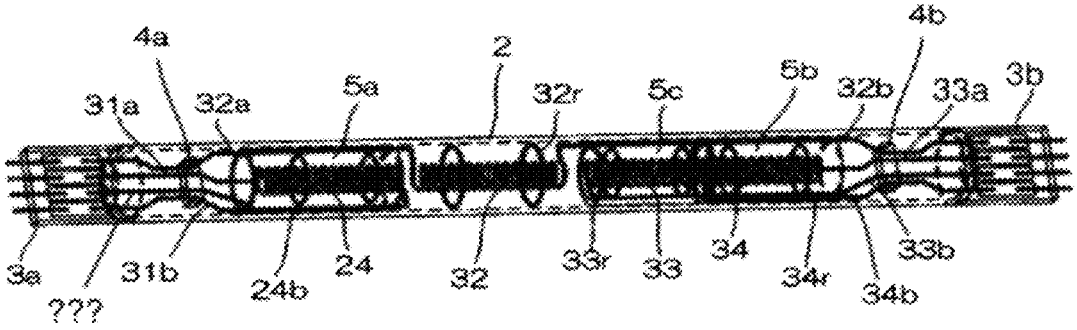
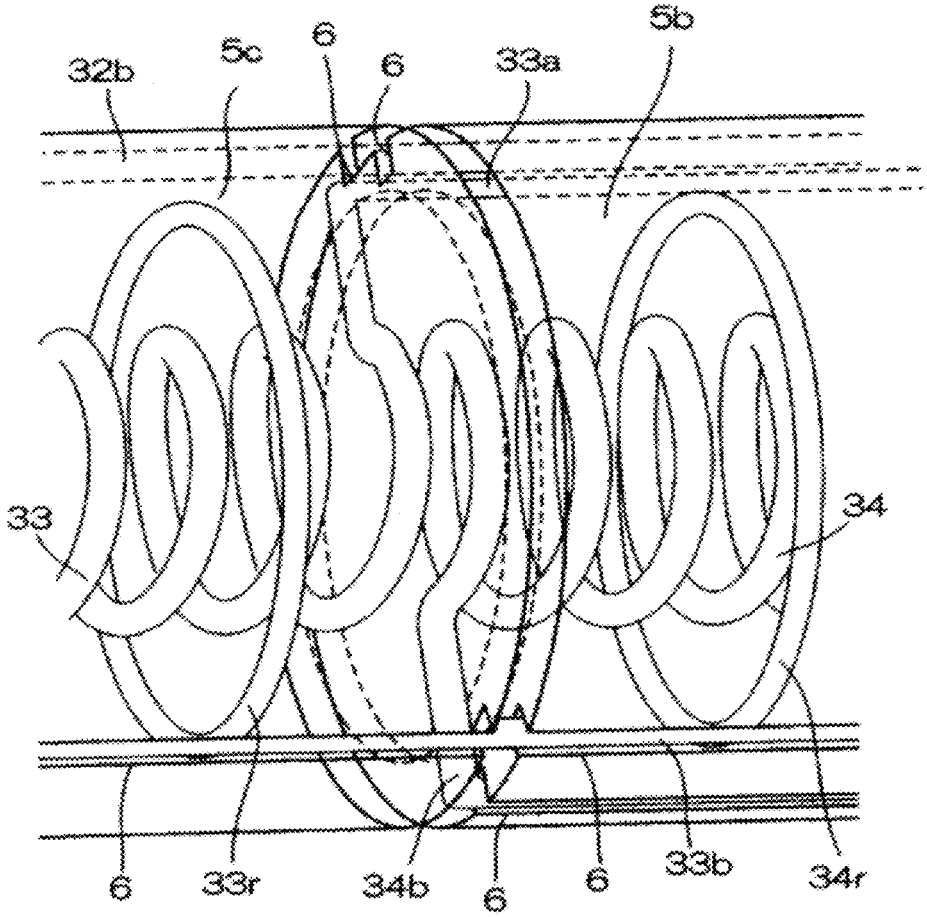
Fig. 8

FILAMENT LAMP

BACKGROUND OF THE INVENTION

1. Field of Invention

The present invention relates to a filament lamp used for the heat treatment of a semiconductor wafer, solar cell or liquid crystal that provides a uniform distribution of light.

2. Description of Related Art

A light irradiation-type heat treatment device in the semiconductor manufacturing process has widely been used in the fields of film formation, diffusion and annealing. All of these heat treatment devices are capable of rapidly heating a semiconductor wafer or other plate-like object such that the temperature can be increased to 1000° C. or above within several seconds to several tens of seconds. There is a need for increasing the temperature at a faster speed recently, and consequently a need for increasing the amount of electric power inputted into such heat treatment devices during the time of the heat treatment. This is referred to as a spike anneal in which the temperature is increased at a high speed exceeding 200° C./second and brought down immediately after a desired temperature has been achieved. The spike anneal enables the formation of a very thin diffusion layer (shallow junction) in the semiconductor wafer, thereby enhancing the efficiency of a semiconductor element manufactured on the wafer.

If the temperature distribution of a semiconductor wafer should become nonuniform at the time of heating, a phenomenon referred to as slip occurs to the semiconductor wafer. In other words, a defect caused by crystal transition occurs, which may lead to a defective product. It is therefore necessary to use a light irradiation-type heat treatment device for heating, maintaining a high temperature of, and cooling a semiconductor wafer when thermally treating a semiconductor wafer. To provide such a uniform distribution of temperature, Japanese Laid-open Application No. 2006-279008 (corresponding to US 2006/0197454 A1) discloses a filament lamp provided with multiple leads capable of independently supplying electric power to multiple filaments in one luminous tube. This design allows adjustment of the amount of electric power inputted into the multiple filaments, thereby allowing the distribution of temperature over an area to be adjusted to a highly uniform pattern.

FIGS. 10(*a*) and 10(*b*) illustrate a conventional filament lamp 1. FIG. 10(*a*) shows a perspective view of the entire filament lamp 1. FIG. 10(*b*) shows a sectional view taken by the A-A' line as shown in FIG. 10(*a*).

A straight-shaped luminous tube 2 has an elliptical cross section, and its both ends are air-tightly sealed with sealing parts 3*a* and 3*b*. Inside the luminous tube 2, coil-shaped filaments 12*a* and 12*b* are provided with multiple ring supporters 12*ar* and 12*br*. Ring supporters 12*ar* and 12*br* are spaced lengthwise and are sequentially disposed in the axial direction of the luminous tube 2. Both ends of the filaments 12*a* and 12*b* are linked with internal leads 13*a*, 13*b*, 13*c* and 13*d* for supplying electric power. The internal leads 13*b* and 13*d* are each covered with an insulating narrow tube made of, for example, quartz glass so that they do not short-circuit to the filaments 12*a* or 12*b* through the ring supporters.

The internal leads 13*a*, 13*b*, 13*c*, and 13*d* connected to the abovementioned filaments 12*a* and 12*b* extend to the sealing parts 3*a* and 3*b* on both ends and are electrically connected to external leads 14*a*, 14*b*, 14*c*, and 14*d* individually via metal foils 11*a*, 11*b*, 11*c*, and 11*d*, respectively. In other words, the internal leads 13*a* and 13*b* extended to one end side of the filaments 12*a* and 12*b* respectively are electrically connected to the external leads 14*a* and 14*b* on one end side via the metal foils 11*a* and 11*b* at the sealing part 3*a* on one end side, respectively. Similarly, the internal leads 13*c* and 13*d* extended to the other end side are electrically connected to the external leads 14*c* and 14*d* on the other end side via the metal foils 11*c* and 11*d* at the sealing part 3*b* on the other end side, respectively.

As shown in FIG. 10, the filaments 12*a* and 12*b* are disposed in parallel with the internal leads 13*b* and 13*d* in order to independently supply electric power to the filaments 12*a* and 12*b* inside the luminous tube 2. The internal leads 13*b* and 13*d* are insulated from the filaments 12*a* and 12*b* by covering them with insulating narrow tubes 8*a* and 8*b*. As shown in FIG. 10(*b*), the filament 12*a* is positioned inside the luminous tube 2 with a ring supporter 12*ar* that is brought into contact with the inner wall of the luminous tube 2.

However, the applicants have observed that the internal lead 13*b* covered with the narrow tube 8*a* protrudes from the inner wall of the smooth luminous tube 2, and therefore may engage the ring supporter 12*ar*. In response to such engagement, the ring supporter 12*ar* might move to either the right or the left in order to expand into a broader space. If the ring supporter 12*ar* deviates from its position, the position of the filament 12*a* also moves. As a result, there may occur a problem in that the distribution of light generated toward an object to be treated may be changed into a nonuniform pattern.

SUMMARY OF THE INVENTION

In view of the abovementioned problems, the object of the present invention is to provide a filament lamp capable of preventing the position of a filament to move while maintaining a secure insulation of the filament from an internal lead, and maintaining a uniform distribution of light, wherein the filament and the internal lead are disposed inside the luminous tube in parallel with each other in the axial direction of the tube.

The first aspect of the invention is the provision of a filament lamp comprising a luminous tube having an inner wall, and opposing ends on which sealing parts are formed, multiple filaments sequentially disposed inside the tube along an axial direction of the tube, internal leads connected to each filament, with at least one of the internal leads running at least partly parallel to at least one of the filaments, and at least one insulating wall disposed along the inner wall in the axial direction of the luminous tube, said at least one insulating wall being disposed around at least one of the multiple filaments, wherein the at least one internal lead running at least partly parallel to at least one filament is provided between the luminous tube and the insulating wall.

The second aspect of invention is the filament lamp of the first aspect, wherein a pathway is provided between the luminous tube and the insulating wall along the axis of the tube from one end to the other end of the insulating wall, and wherein the internal lead is provided in the pathway.

The third aspect of the invention is the filament lamp of the first aspect, wherein the filament around which the insulating wall is disposed is provided with multiple ring supporters spaced lengthwise.

A further aspect of the invention is the filament lamp of the first aspect wherein two insulating walls are spaced apart from each other in the axial direction of the tube.

A still further aspect of the invention is the filament lamp of the first aspect wherein two insulating walls are arranged adjacent to each other in the axial direction of the tube.

A further aspect of the invention is the filament lamp of either the previous aspect, with the insulating walls disposed adjacent to each other, wherein a notch part is provided on one insulating wall and a collar part on the other insulating wall, and the notch part and the collar part are joined together.

According to the first aspect of the invention, since a filament is disposed on the inner side of the insulating wall, the filament can be disposed substantially at the center of the insulating wall. Moreover, since the inner surface of the insulating wall has no protrusion and is smooth, the position of the filament that generates light remains the same. Accordingly, the distribution of light generated toward an object to be treated can be maintained in the filament lamp.

Furthermore, since the internal lead provided in parallel with the filament in the axial direction of the tube is disposed between the luminous tube and the insulating wall, the filament can be insulated from the internal lead without covering the internal lead with a narrow tube.

According to the second aspect of the invention, since a pathway is provided along the axis of the tube from one end to the other end between the luminous tube and the insulating wall and the internal lead is provided in the pathway, the pathway positions the internal lead. Accordingly, the disposed position thereof inside the luminous tube does not move. It is therefore possible to avoid the problem that light irradiated from the filament is blocked from an object to be treated arising out of the lopsided movement of the position of an internal lead at the time of turning on or off the lamp.

According to the third aspect of the invention, since the filament around which the insulating wall is disposed is provided with multiple ring supporters spaced lengthwise, the filament can be disposed substantially at the center of the insulating wall. Besides, since the inner surface of the insulating wall has no protrusion and is smooth, the position of ring supporters remains the same.

According to the aspect of the invention, where a notch part is provided on the contact surface between the insulating walls, and a collar part is provided at the position corresponding to the notch part on the contact surface between the insulating walls, it is possible to make the insulating walls unable to rotate independently by joining the notch part and the collar part together.

BRIEF DESCRIPTION OF DRAWINGS

FIG. 3 is a schematic partial sectional view of a filament lamp according to the present invention.

FIG. 4 is a schematic perspective view of a filament lamp according to the present invention.

FIG. 7 is a schematic perspective view showing a filament lamp according to the present invention.

FIG. 8 is an enlarged schematic perspective view showing a filament lamp according to the present invention.

DETAILED DESCRIPTION OF THE INVENTION

Figure 1:
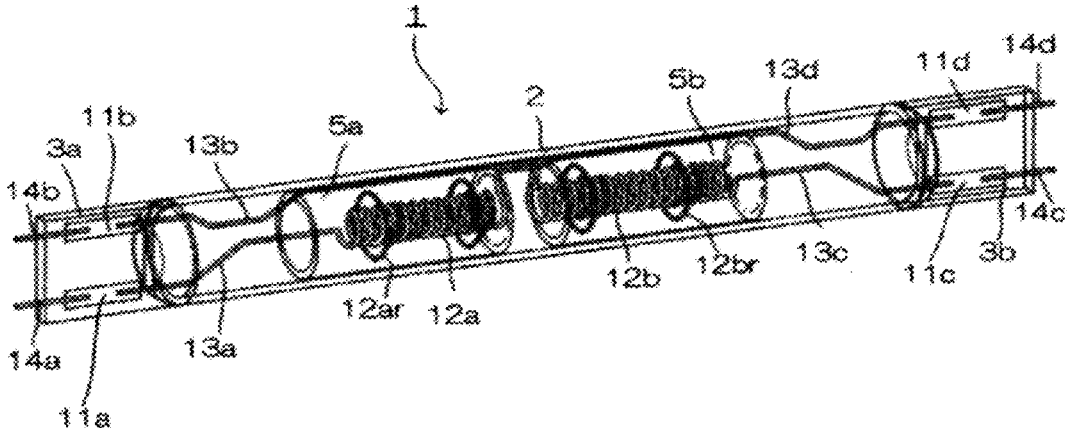
FIG. 1 is a schematic perspective view of the filament lamp according to the present invention.

FIG. 1 is a perspective view showing a filament lamp 1 according to the first embodiment.

The filament lamp 1 is provided with a luminous tube 2 made of light-transparent material such as quartz glass. On both ends of the luminous tube 2 are formed sealing parts 3*a* and 3*b* with pinch seals in which metal foils 11*a*, 11*b*, 11*c* and 11*d* are buried. The inside of the luminous tube is sealed air-tight. Inside the luminous tube 2, filaments 12*a* and 12*b*, which are made of tungsten, for example, and divided into two parts in the axial direction of the luminous tube 2, are provided on the same axis along the axis of the luminous tube 2.

The filament 12*a* is electrically connected to an internal lead 13*a* on its one end side that is connected to the metal foil 11*a* and electrically connected to an internal lead 13*d* on the other end side that is connected to the metal foil 11*d*.

As with the filament 12*a*, the filament 12*b* is electrically connected to an internal lead 13*c* on its one end side that is connected to the metal foil 11*c* and electrically connected to an internal lead 13*b* on the other end side that is connected to the metal foil 11*b*. The internal lead 13*b* is connected to the other end side of the filament 12*b*.

Thus, the filament 12*a* is provided with the internal lead 13*b* in parallel in the axial direction of the tube for supplying electric power to the filament 12*b*, and the filament 12*b* is provided with the internal lead 13*d* in parallel in the axial direction of the tube for supplying electric power to the filament 12*a*.

One internal lead 13*a* (13*b*) is led to one sealing part 3*a* and the other internal lead 13*d* (13*c*) to the other sealing part 3*b*. In other word, the internal lead 13*a* and 13*d* (13*b* and 13*c*) connected to the filament 12*a* (12*b*) are led to different sealing parts 3*a* and 3*b*. Accordingly, the filament 12*a* (12*b*) and the internal lead 13*b* (13*d*), which are charged to different electric potentials, are provided in parallel with each other in the axial direction of the tube in the case that electric power is independently supplied to each filament 12*a* (12*b*) from the sealing parts 3*a* and 3*b* on both ends.

The metal foils 11*a* and 11*b* buried on the side of the sealing part 3*a* are electrically connected with external leads 14*a* and 14*b* that are each led to the outside from the sealing part 3*a*. Similarly, metal foils 11*c* and 11*d* buried on the side of the sealing part 3*b* are electrically connected with external leads 14*c* and 14*d* that are each led to the outside from the sealing part 3*b*. In this manner, the filament 12*a* is electrically connected to the external leads 14*a* and 14*d*, and the filament 12*b* is electrically connected to the external leads 14*b* and 14*c*.

Inside the luminous tube 2, two insulating walls 5*a* and 5*b* made of quartz glass are disposed, and the filaments 12*a* and 12*b* are provided on the inner side of the insulating walls 5*a* and 5*b*. The formation is such that the length of the insulating walls 5*a* and 5*b* in the axial direction of the tube is equal to the full length of the filaments 12*a* and 12*b* to which electric power is independently supplied or slightly longer than the full length of the filaments 12*a* and 12*b*, respectively. However, the insulating wall 5*a* covering the filament 12*a* is not formed so long as to reach the filament 12*b* connected to the other feed circuit. This is because the structure is such that the internal leads 13*d* and 13*b* can be routed from between the insulating wall 5*a* and the insulating wall 5*b* for supplying electric power to the filaments 12*a* and 12*b*.

Figure 2:
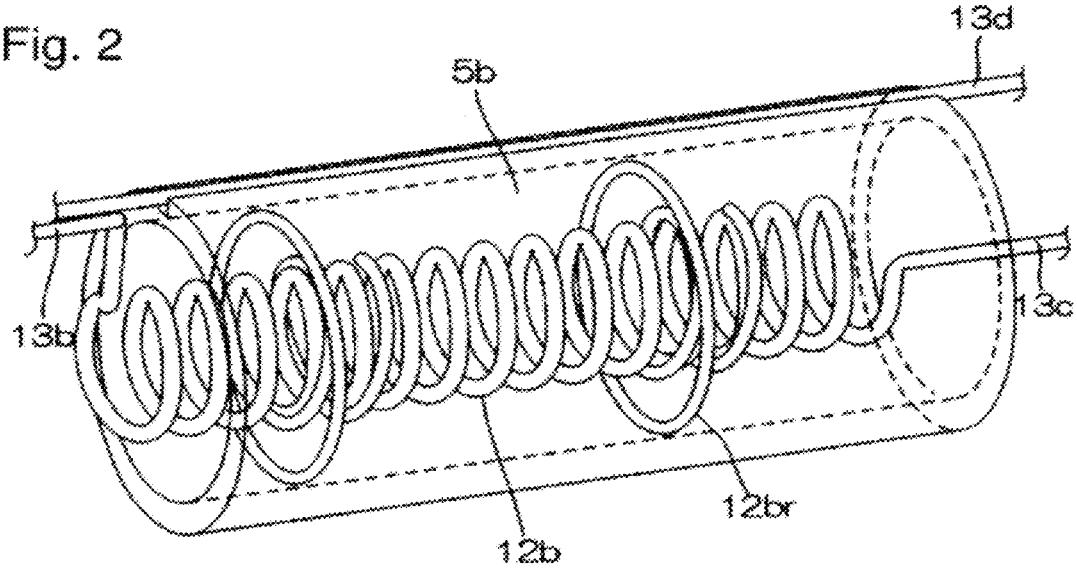
FIG. 2 is an enlarged schematic perspective view of the filament lamp according to the present invention.

FIG. 2 is an enlarged perspective view of the portion in which the insulating wall 5*b* is formed in the filament lamp 1 according to the first embodiment.

The filament 12*b* can be disposed substantially at the center of the insulating wall 5*b* because the filament 12*b* provided with multiple ring supporters 12*br* spaced lengthwise are disposed on the inner side of the insulating wall 5*b* having a substantially cylindrical shape. Moreover, since the inner surface of the insulating wall 5*b* has no protrusion and is smooth, there is no possibility that the positions of the ring supporters 12*br* move lopsidedly.

Because the positions of the ring supporters 12*br* do not move lopsidedly, the filament 12*b* can also be disposed and kept substantially at the center of the insulating wall 5*b*. Furthermore, since the position of the filament 12*b* that generates light does not move lopsidedly, it is possible to maintain the same distribution of light generated by the filament lamp toward an object to be treated.

Besides, the internal lead 13*d*, which is provided in parallel with the filament 12*b* in the axial direction of the tube, is disposed between the luminous tube 2 and the insulating wall 5*b*. Since the filament 12*b* is disposed on the inner side of the insulating wall 5*b*, the filament 12*b* can be insulated from the internal lead 13*d* without covering the internal lead 13*d* with a narrow tube.

FIG. 3 is a sectional view of the portion in which the insulating wall 5*b* is formed in the filament lamp 1 according to the first embodiment.

On the outer peripheral surface of the insulating wall 5*b* is formed a groove 6 extending from one end to the other end of the insulating wall 5*b* along the tube axis. The formation of the groove 6 on the outer peripheral surface of the insulating wall 5*b* allows forming a gap between the luminous tube 2 and the insulating wall 5*b*, and the recessed portion of the groove 6 becomes a pathway extending from one end to the other end of the insulating wall 5*b*. The internal lead 13*d* is provided in this pathway.

Since the filament 12*b* is disposed on the inner side of the insulating wall 5*b*, the diameter of the insulating wall 5*b* must be large to a certain degree in view of the diameter of the filament 12*b* and the high temperature of the insulating wall 5*b* arising out of the heat generated from the filament 12*b*. However, the outer diameter of the luminous tube 2 should not be very large in order to provide the filament lamp according to the present invention as a replacement for a conventional type filament lamp in which no insulating wall 5*b* is disposed inside the luminous tube 2. The diameter of the insulating wall 5*b* can be made so large as to come into contact with the luminous tube 2 by forming the groove 6 on the outer peripheral surface of the insulating wall 5*b* to form a gap extending between the luminous tube 2 and the insulating wall along the axis of the tube and providing the internal leads 13*c*, 13*d* using this gap as a pathway. Accordingly, the insulating wall 5*b* can be disposed inside without making the outer diameter of the luminous tube 2 very large.

Moreover, since the filament 12*b* and the internal lead 13*d* are disposed in parallel with each other, the internal lead 13*d* is easily heated by the heat generated from the filament 12*b*, which leads to the extension and contraction of the internal lead 13*d* as a result of turning on and off the lamp. If there exists any strain formed at the time of the formation of the internal lead 13*d*, the force is applied in a manner of restoring the strain according to the extension and contraction of the internal lead 13*d*. However, the position of the disposed internal lead 13*d* does not move lopsidedly because the internal lead 13*d* is positioned in the gap formed between the groove 6 formed in the insulating wall 5*b* and the luminous tube 2 as a pathway. It is therefore possible to avoid the problem that light irradiated from the filament 12*b* is blocked from an object to be treated arising out of the lopsided movement of the position of the internal lead 13*d* at the time of turning on or off the lamp.

In the filament lamp 1 according to the first embodiment, a groove is provided on the outer peripheral surface of the insulating walls 5*a* and 5*b* in order to form a pathway. However, the way of forming a pathway is not limited to this embodiment. For example, a groove may be provided on the inner peripheral surface of the luminous tube 2 in place of the outer peripheral surface of the insulating walls 5*a* and 5*b* to form a gap extending along the axis of the tube between the luminous tube 2 and the insulating walls, and this gap is used as a pathway.

Next, a description of the procedure for forming the filament lamp 1 according to the first embodiment is given below.

First, the internal leads 13*a*, 13*b*, 13*c* and 13*d* are bent to form a specified shape thereof. The filaments 12*a* and 12*b* are connected to the tip ends of the internal leads 13*a*, 13*b*, 13*c* and 13*d*. Next, the insulating walls 5*a* and 5*b* are inserted from the ends of the internal leads 13*a*, 13*b*, 13*c* and 13*d* and positioned such that the internal leads 13*a*, 13*b*, 13*c* and 13*d* are provided in the recessed portion of the groove 6. Furthermore, the metal foils 11*a*, 1*b*, 11*c* and 11*d* are welded to the ends of the internal leads 13*a*, 13*b*, 13*c* and 13*d*, and then the external leads 14*a*, 14*b*, 14*c* and 14*d* are welded to the other ends of the metal foils 11*a*, 1*b*, 11*c* and 11*d*.

A mount insert constituted of the internal leads 13*a*, 13*b*, 13*c* and 13*d*, a connecting member 15, a holding member 4*a*, a holding member 4*b*, the filaments 12*a* and 12*b*, the metal foils 11*a*, 11*b*, 11*c* and 11*d* and the external leads 14*a*, 14*b*, 14*c* and 14*d* thus formed is inserted into the luminous tube 2. The luminous tube 2 having the mount insert disposed inside is sealed at the portions where the metal foils 11*a* and 11*b*, and the metal foils 11*c* and 11*d* are disposed to form the sealing parts 3*a* and 3*b*.

The following shows specific numerical values.

Luminous tube
- Outer diameter: 13 mm-16 mm
- Thickness: 1.0 mm-1.5 mm

Insulating tube
- Length: 30 mm-250 mm
- Outer diameter: 10 mm-13 mm
- Thickness: 1.0 mm-2.0 mm
- Groove (width): 0.7 mm-1.1 mm
- Groove (depth): 0.4 mm-0.8 mm
- Diameter of lead wire: 0.5 mm-1.0 mm Filament
- Diameter of winding wire: 1.0 mm-4.0 mm
- Length: 30 mm-200 mm FIG. 4 shows a perspective view of the filament lamp 1 according to the second embodiment.

Inside the luminous tube 2 are disposed three filaments 24, 25 and 26 in the axial direction of the tube. Internal leads 24*a*, 24*b*, 26*a* and 26*b* connected to both ends of two filaments 24 and 26, which are disposed proximate to sealing parts 3*a* and 3*b* respectively, extend in the directions of the same sealing parts to be held by the sealing parts 3*a* and 3*b*, respectively. Moreover, internal leads 25*a* and 25*b* connected to both ends of the filament 25, which is disposed between two filaments 24 and 26, extend toward the opposite directions in the axial direction of the luminous tube 2 to be held at the sealing parts 3*a* and 3*b* on both ends.

Specifically, each of the internal leads 24*a* and 24*b* of the filament 24 proximate to the sealing part 3*a* on one end portion extend from the sealing part 3*a* and is connected to the end portion of the filament 24. Both of these internal leads 24*a* and 24*b* are held at the same sealing parts 3*a* in such a manner as to be connected to metal foils 21*a* and 21*b*.

On the other hand, the internal leads 25*a* and 25*b* of the filament 25 disposed at the central portion extend toward the sealing parts 3*a* and 3*b* on both ends and are held at the sealing parts 3*a* and 3*b* in such a manner as to be connected to metal foils 22*a* and 22*b*, respectively.

The filament 26 proximate to the sealing part 3*b* on the other end side is similar to the abovementioned filament 24. The internal leads 26*a* and 26*b* are held at the sealing part 3*b* on the other end portion in such a manner as to be connected to metal foils 23*a* and 23*b*.

The metal foils 21*a*, 21*b*, 22*a*, 22*b*, 23*a* and 23*b* are connected with external leads 27*a*, 27*b*, 28*a*, 28*b*, 29*a* and 29*b*, respectively.

Moreover, glass bridges 4*a* and 4*b* are provided in the vicinity of the sealing parts 3*a* and 3*b* inside the luminous tube 2. The glass bridges 4*a* and 4*b* are each constituted of a pair of cylindrical glass members, and the internal leads 24*a*, 24*b* and 25*a*, and the internal leads 25*b*, 26*a* and 26*b* are held therebetween, respectively.

In the abovementioned configuration, no internal lead extends in the vicinity of the filament 25 at the central portion. Accordingly, there is no possibility that light irradiated from the filament 25 positioned immediately above an object to be treated is blocked by an internal lead. As a result, uniform irradiation can be achieved.

An insulating wall 5*a* is disposed in a manner of covering the filament 24 proximate to the sealing part 3*a* on one end portion, and an insulating wall 5*b* is disposed in a manner of covering the filament 26 proximate to the sealing part 3*b* on the other end portion. On the other hand, no internal lead extends in the vicinity of the filament 25 at the central portion. Since there is no need for the filament 25 to be insulated from the others, the insulating walls 5*a* or 5*b* is not disposed around the filament 25.

Figure 5:
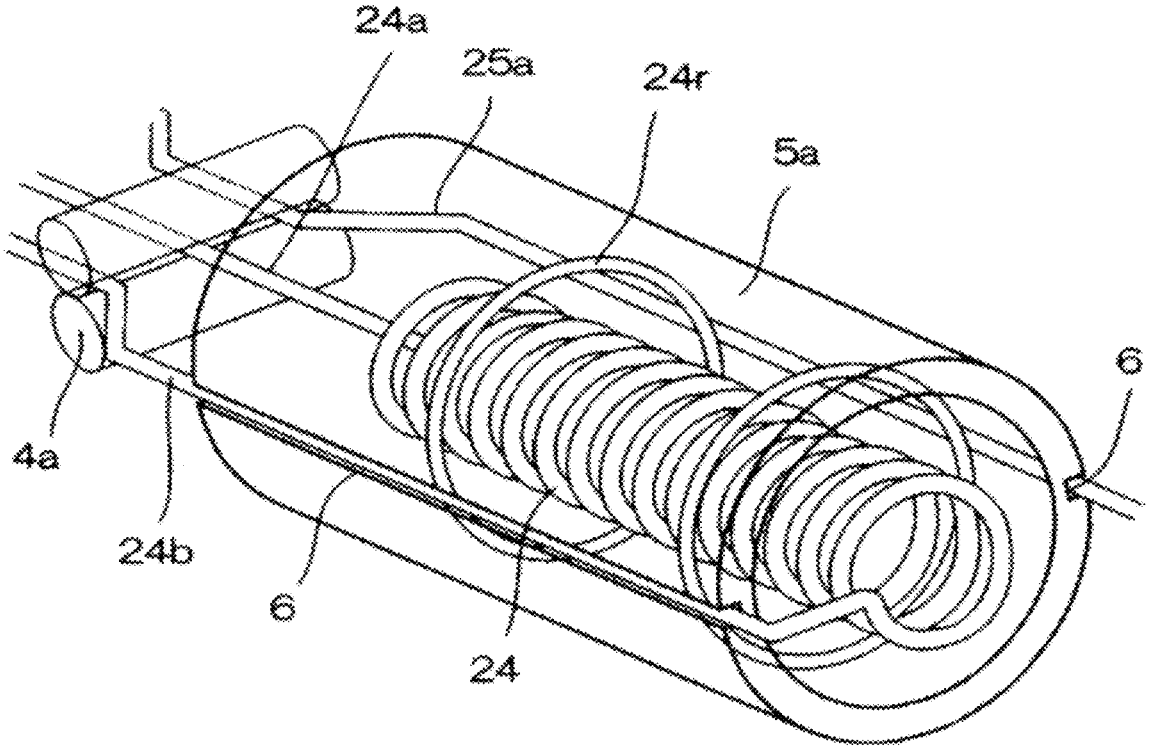
FIG. 5 is an enlarged schematic perspective view of a filament lamp according to the present invention.

FIG. 5 is an enlarged perspective view in the vicinity of the filament 24 in the filament lamp 1 according to the second embodiment.

In the vicinity of the filament 24 are provided the internal lead 24*b* for supplying electric power to the filament 24 and the internal lead 25*a* for supplying electric power to the filament 25 in parallel with each other in the axial direction of the tube. Electric power cannot independently be supplied to each of the filaments 24, 25 and 26 unless the filament 24 is insulated from the internal leads 24*b* and 25*a*.

Inside the luminous tube 2 is disposed the insulating wall 5*a* made of quartz glass, and the filament is provided on the inner side of the insulating wall 5*a*. The internal leads 24*b* and 25*a* provided in parallel with the filament 24 in the axial direction of the tube are disposed between the luminous tube 2 and the insulating wall 5*a*. Accordingly, the internal leads 24*b* and 25*a* can be isolated from the filament 24 without covering them with a narrow tube.

Since multiple ring supporters 24*r* are provided spaced lengthwise on the filament 24, the filament 24 can be disposed at the center of the insulating wall 5*a* that is substantially cylindrical. Since the inner surface of the insulating wall 5*a* has no protrusion and is smooth, there is no possibility that the positions of the ring supporters 24*r* move lopsidedly. The distribution of light generated by a filament lamp toward an object to be treated can be maintained because the positions of the filament 12*a* and 12*b* that generate light do not change.

On the outer peripheral surface of the insulating wall 5*a* is formed a groove 6 extending from one end to the other end of the insulating wall 5*a* along the axis of the tube. The formation of the groove 6 on the outer peripheral surface of the insulating wall 5*a* allows forming a gap between the luminous tube 2 and the insulating wall, and the recessed portion of the groove 6 becomes a pathway extending from one end to the other end of the insulating wall 5*a*. The internal leads 24*b* and 25*a* are provided in this pathway. Because the pathway positions the internal leads 24*b* and 25*a*, there is no possibility that the internal leads 24*b* and 25*a* move lopsidedly while the filament lamp 1 is turned on. It is therefore possible to avoid the problem that light irradiated from the filament is blocked from an object to be treated arising out of the lopsided movement of the positions of the internal leads 24*b* and 25*a* at the time of turning on or off the lamp.

The internal lead 24*b* connected to one end of the filament 24 adjacent to the filament 25 extends from the sealing part 3*a* in parallel with the filament 24, is bent in the radial direction at its tip end, and is further bent in the axial direction, thereby forming a U-shape. One end of the insulating wall 5*a* is brought into contact with the U-shaped portion of the internal lead 24*b*.

In the vicinity of the other end of the insulating wall 5*a* is provided a glass bridge 4*a* having the maximum length longer than the inner diameter of the insulating wall 5*a*. Accordingly, there is no possibility that the insulating wall 5*a* goes over the glass bridge 4*a* arranged on the side of the sealing part 3*a*.

The configuration is such that the insulating wall 5*a* does not come off because it is brought into contact with the U-shaped internal lead 24*b* on its end, and the glass bridge 4*a* is disposed in the vicinity of the other end. Accordingly, it can be positioned in a manner of being unable to move in the axial direction of the insulating wall 5*a*.

Figure 6A:
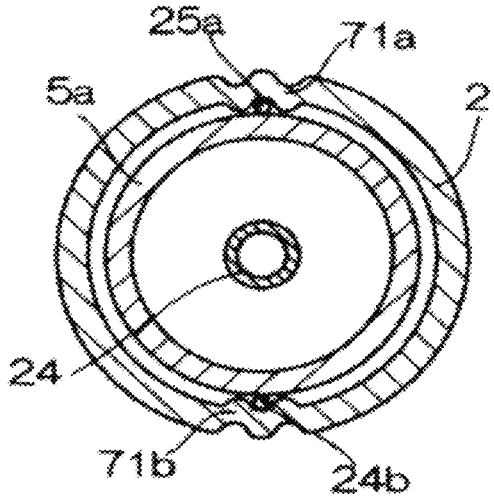
FIG. 6(*a*) to (*c*) are a schematic partial sectional views showing a filament lamp according to the present invention.
Figure 6B:
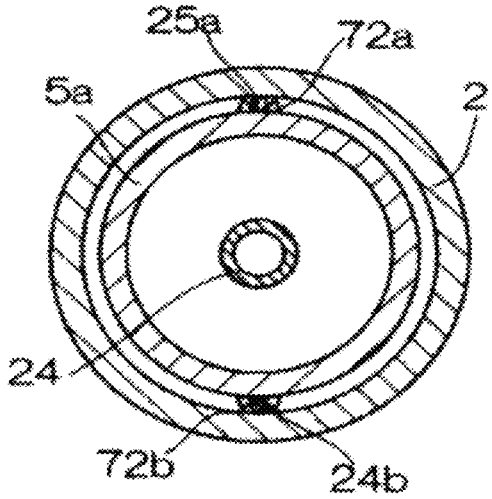
Figure 6C:
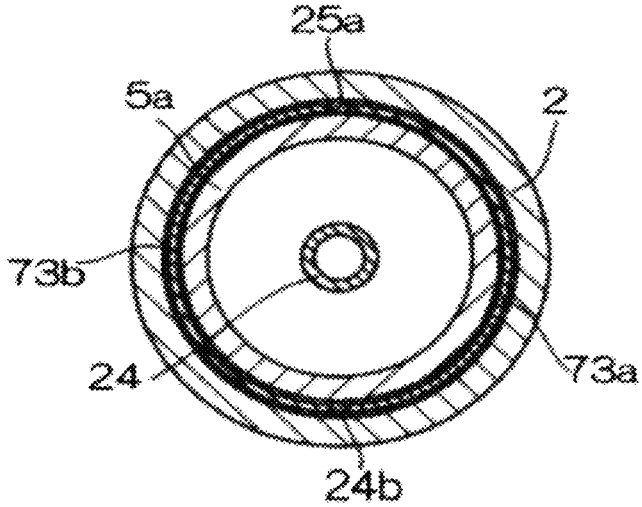

The following shows a variation of the filament lamp 1 according to the second embodiment. FIG. 6 is a sectional view of the filament lamp 1 when it is perpendicularly cut in the vicinity of the filament 24 in the axial direction of the tube.

As shown in FIG. 6(*a*), dimples 71*a* and 71*b* corresponding to the internal leads 24*b* and 25*a* provided between the luminous tube 2 and the insulating wall 5*a* are provided in the luminous tube 2 without providing a groove on the outer peripheral surface on the insulating wall 5*a* in order to position the internal leads 24*b* and 25*a*. These dimples 71*a* and 71*b* are used as channels extending from one end to the other end of the insulating wall 5*a*.

The dimples 71*a* and 71*b* may not need to be provided for the entire length of the internal leads 24*b* and 25*a* in the axial direction yet may be interspersed at several places so that the internal leads 24*b* and 25*a* can be positioned.

In addition, as shown in FIGS. 6(*b*) and (*c*), channels extending from one end to the other end of the axis of the tube can be provided without providing a groove on the outer peripheral surface of the insulating wall 5*a* or the dimples 71*a* and 71*b* in the luminous tube 2. Channels for positioning the internal leads 24*b* and 25*a* can be provided by making the outer surface of the insulating wall 5*a* and the inner surface of the luminous tube 2 smooth and then disposing particulates of quartz glass 72*a* and 72*b* here and there on the outer surface of the insulating wall 5*a* as shown in FIG. 6(*b*). Alternatively, as shown in FIG. 6(*c*), halves of quartz glass (troughs) 73*a* and 73*b* are disposed between the luminous tube 2 and the insulating wall 5*a*, and then the internal leads 24*b* and 25*a* are disposed in the gaps, thereby providing channels.

As with the dimples 71*a* and 71*b*, neither the particulates of quartz glass 72*a* and 72*b* nor the quartz glass troughs 73*a* and 73*b* may need to be provided for the entire length of the internal leads 24*b* and 25*a* in the axial direction yet may be interspersed at several places so that the internal leads 24*b* and 25*a* can be positioned.

FIG. 7 is a perspective view showing the filament lamp 1 according to the third embodiment.

In the filament lamp 1 according to the third embodiment, as with the filament lamp 1 according to the second embodiment, internal leads 31*a*, 31*b*, 34*a* and 34*b* connected to both ends of two filaments 31 and 34, which are disposed proximate to sealing parts 3*a* and 3*b* respectively, extend in the direction of the same sealing part proximate to the filaments 31 and 34 to be held by the sealing parts 3*a* and 3*b*.

On the other hand, unlike the filament lamp 1 according to the second embodiment, at the central portion are disposed two filaments 32 and 33 to which electric power is independently supplied. Internal leads 33*a* and 33*b* connected to the filament 33 are connected to metal foils held in the sealing part 3*b*. Internal leads 32*a* and 32*b* connected to the other filament 32 extend in the directions of the sealing parts 3*a* and 3*b* on both ends and are held at the sealing parts 3*a* and 3*b* in such a manner as to be connected to metal foils, respectively.

An insulating wall 5*a* is disposed in a manner of covering the filament 31 proximate to the sealing part 3*a* on one end portion, and an insulating wall 5*b* is disposed in a manner of covering the filament 34 proximate to the sealing part 3*b* on the other end portion. Moreover, an insulating wall 5*c* is disposed adjacent to the insulating wall 5*b* in a manner of covering the filament 33 disposed at the center. Thus, the insulating wall 5*c* is disposed around the filament 33 as well if there is a filament 33, in the vicinity from which internal leads extend, in addition to the filaments 31 and 34 disposed proximate to the sealing parts 3*a* and 3*b*, respectively.

On the other hand, no internal leads extend in the vicinity of the other filament 32 at the central portion. Since there is no need for the filament 32 to be insulated from the others, the insulating walls 5*a*, 5*b* or 5*c* are not disposed around the filament 32.

FIG. 8 is an enlarged perspective view showing the portion at which the filament 33 and the filament 34 are adjacent to each other in the filament lamp 1 according to the third embodiment.

On the outer surface of the insulating wall 5*c* are formed a groove 6 for disposing the internal lead 33*b* connected to one end of the filament 33, and a groove 6 for disposing the internal lead 32*b* used for supplying electric power to the filament 32.

On the outer surface of the insulating wall 5*b* are formed a groove 6 for disposing the internal lead 33*a* connected to the other end of the filament 33 and a groove 6 for disposing the internal lead 34*b* connected to one end of the filament 34 in addition to the groove 6 for disposing the internal lead 33*b* and the groove 6 for disposing the internal lead 32*b*.

On the outer surface of the insulating wall 5*b* and 5*c* are formed grooves 6 extending from one end to the other end of the insulating walls 5*b* and 5*c* respectively along the axis of the tube depending on the number of internal leads 32*b*, 33*a*, 33*b* and 34*b* disposed in parallel. The formation of the grooves 6 on the outer surfaces of the insulating walls 5*b* and 5*c* allows forming gaps between the luminous tube 2 and the insulating walls, and the recessed parts of the grooves 6 are used as channels that extend from one end to the other end of the insulating walls 5*b* and 5*c*.

The internal lead 34*b* and the internal lead 33*a* provided between the insulating wall 5*b* and the luminous tube are bent between the insulating wall 5*b* and the insulating wall 5*c* in the radial direction in order to wire them on the inner sides of the insulating wall 5*b* and the insulating wall 5*c*, respectively.

Figure 9A:
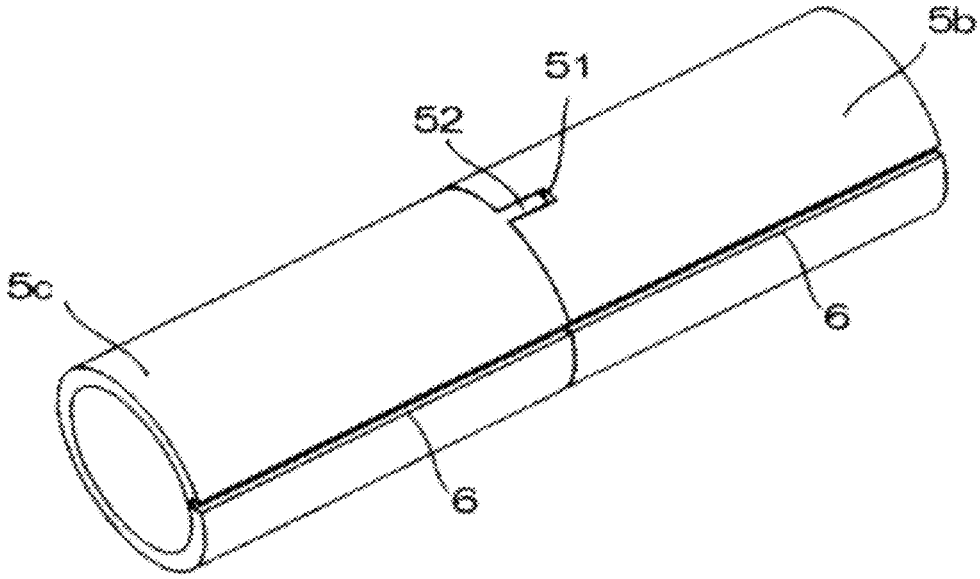
FIGS. 9(*a*) and (*b*) are enlarged schematic perspective views showing the insulating walls of filament lamps according to the present invention.
Figure 9B:
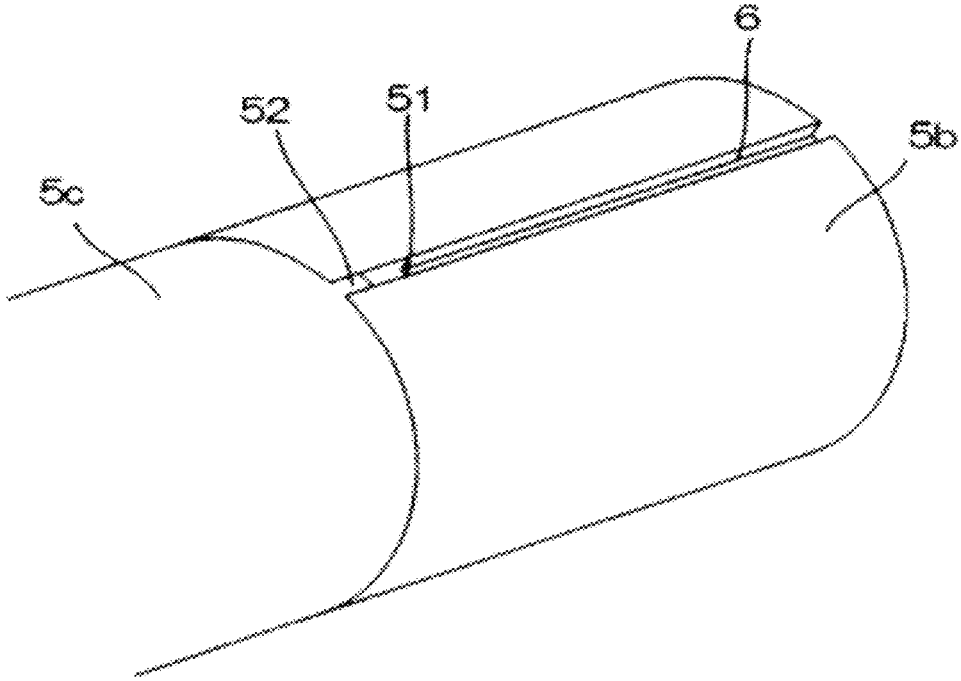
Figure 10A:
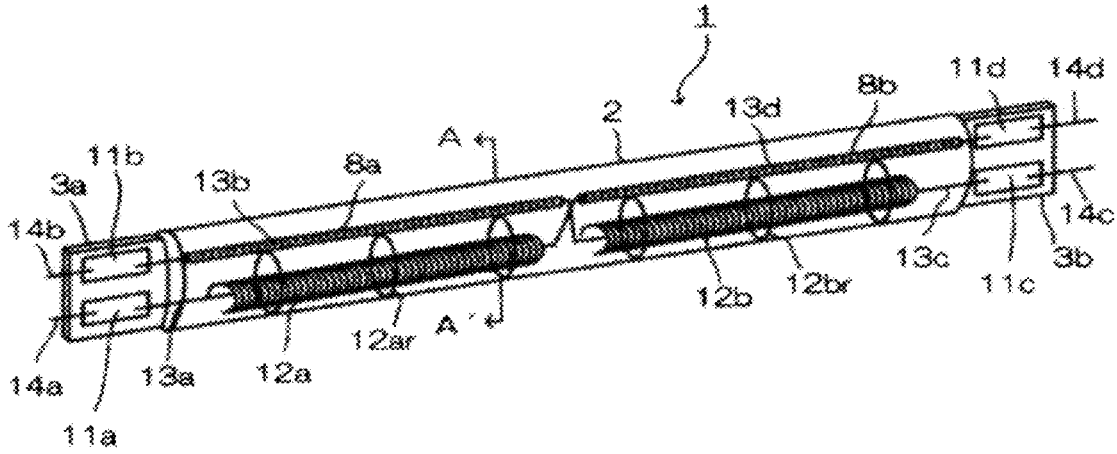
Fig. 10(a) (Prior Art)
FIGS. 10(*a*) and (*b*) are perspective views showing a conventional filament lamp.
Figure 10B:
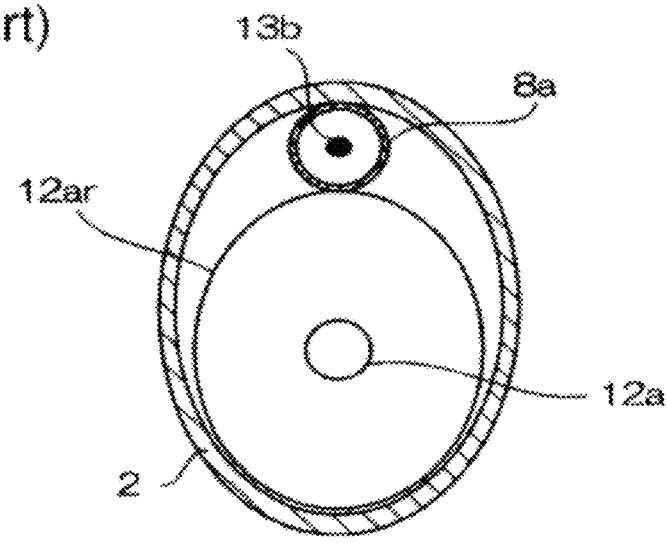
Fig. 10(b) (Prior Art)

The following shows a variation of the filament lamp 1 according to the third embodiment. FIG. 9 is a perspective view explaining a method for connecting the two adjacent insulating walls 5*b* and 5*c*.

As shown in FIG. 9(*a*), it is possible to make the insulating wall 5*c* and the insulating wall 5*b* unable to rotate separately by providing a notch part 51 on the contact surface between the insulating wall 5*b* and the insulating wall 5*c* and a collar part 52 at the position corresponding to the notch part 51 on the contact surface between the insulating wall 5*b* and the insulating wall 5*c*, and then joining the notch part 51 and the collar part 52 together. As shown in the drawing, if there is a groove 6 extending between the insulating wall 5*b* and the insulating wall 5*c*, it is preferable to have a rotation preventing mechanism constituted of the notch part 51 and the collar part 52.

As shown in FIG. 9(*b*), a notch part 51 may be formed in a groove 6 formed on the outer peripheral surface of the insulating wall 5*b*. The insulating wall 5*b* and the insulating wall 5*c* can be disposed closely to each other by joining the notch part 51 formed in the groove 6 and the collar part 52 formed at the position corresponding to the notch part 51 together. However, the collar part 52 formed on the insulating wall 5*c* does not reach the proximal end of the notch part 51 formed on the insulating wall 5*b*. Instead, the formation is such that there is a gap between the collar part 52 and the notch part 51. The internal leads provided on the groove 6 of the insulating wall 5*b* can be wired to be connected to the filaments inside the insulating wall 5*b* and the insulating wall 5*c* through the gap between the color part 52 and the notch part 51.

In all of the filament lamps as shown in the first embodiment through the third embodiment, the sealing parts 3*a* and 3*b* are pinch-sealed. The configuration of the present invention can be applied to a shrink seal filament lamp as well in place of the pinch-sealed filament lamp. The structural advantage of using the shrink seal at the sealing part is that the internal leads can be inserted into the sealing parts 3*a* and 3*b* and sealed there as they are led along the inner surface of the luminous tube 2.

What is claimed is:

1. A filament lamp comprising a luminous tube having an inner wall, and opposing ends on which sealing parts are formed;

multiple filaments sequentially disposed inside the luminous tube along an axial direction of the luminous tube and to which electic power is independently supplied;

internal leads connected to each filament, with the internal leads running at least partly parallel to the filaments, and an insulating tube disposed facing the inner wall in the axial direction of the luminous tube, said insulating tube being disposed surrounding at least one of the multiple filaments along the full length of said filament in the axial direction of the luminous tube, wherein the internal lead is located in a small gap between the luminous tube and the insulating tube.

2. The filament lamp according to claim 1, wherein a pathway is provided between the luminous tube and the insulating tube along the axis of the tube from one end to the other end of the insulating tube, and wherein the internal lead is provided in the pathway.

3. The filament lamp according to claim 1, wherein the insulating tube has a substantially cylindrical shape.

4. The filament lamp according to claim 1, wherein two insulating tube are provided which are spaced apart from each other in the axial direction of the tube.

5. The filament lamp according to claim 1, wherein two insulating tube are arranged adjacent to one another.

6. The filament lamp according to claim 1, wherein the filament around which the insulating tube is disposed is provided with multiple ring supporters spaced lengthwise.

7. The filament lamp according to claim 2, wherein said pathway is defined by an axially-oriented groove in the insulating tube.

8. The filament lamp according to claim 2, wherein said pathway is defined by dimples extending from one end to the other end of the insulating tube.

9. The filament lamp according to claim 2, wherein said pathway is defined by two rows of quartz glass particulates extending from one end to the other end on the outer surface of the insulating tube.

10. The filament lamp according to claim 2, wherein said pathway is defined by two troughs of quartz glass arranged opposite each other in the luminous tube leaving said gap between them.

11. The filament lamp according to claim 4, wherein three filaments are sequentially arranged and an insulating tube is provided around each of the two outer filaments.

12. The filament lamp according to claim 5, wherein an opening is provided between the adjacent insulating tubes for guiding an internal lead inside for connecting one of said filaments.

13. The filament lamp according to claim 5, wherein a notch part is provided on one insulating tube and a collar part on the other insulating tube; and the notch part and the collar part are joined together.

14. The filament lamp according to claim 12, wherein a notch part is provided on one insulating tube and a collar part on the other insulating tube; and the notch part and the collar part are joined together.

* * * * *